US010329055B2

(12) United States Patent
Combe

(10) Patent No.: US 10,329,055 B2
(45) Date of Patent: Jun. 25, 2019

(54) METAL CANS WITH PEELABLE LIDS

(75) Inventor: Florian Christian Gregory Combe, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 14/233,925

(22) PCT Filed: Jul. 11, 2012

(86) PCT No.: PCT/EP2012/063585

§ 371 (c)(1),
(2), (4) Date: Jan. 21, 2014

(87) PCT Pub. No.: WO2013/010875

PCT Pub. Date: Jan. 24, 2013

(65) Prior Publication Data

US 2014/0166655 A1 Jun. 19, 2014

(30) Foreign Application Priority Data

Jul. 21, 2011 (EP) ..... 11174917

(51) Int. Cl.

| | |
|---|---|
| ***B65D 43/02*** | (2006.01) |
| ***B65D 17/50*** | (2006.01) |
| ***B65D 51/20*** | (2006.01) |
| ***B65D 25/08*** | (2006.01) |
| ***B65D 77/24*** | (2006.01) |

(52) U.S. Cl.

CPC ..... *B65D 43/02* (2013.01); *B65D 17/502* (2013.01); *B65D 25/08* (2013.01); *B65D 51/20* (2013.01); *B65D 77/245* (2013.01); *B65D 2251/0093* (2013.01)

(58) Field of Classification Search

CPC ..... B65D 43/02; B65D 51/20; B65D 17/502
USPC ..... 220/569, 733, 906, 359.1, 359.2, 359.3, 220/669, 670, 677, 359.4–359.5, 608, 220/276, 359; 29/428
See application file for complete search history.

(56) References Cited

U.S. PATENT DOCUMENTS

| | | | | |
|---|---|---|---|---|
| 1,773,947 A | | 8/1930 | Cadwallader | |
| 3,358,876 A | | 12/1967 | Joosten et al. | |
| 4,328,905 A | * | 5/1982 | Hardt | 220/258.2 |
| 4,457,465 A | * | 7/1984 | Shepard | B65D 15/06 220/620 |
| 4,813,592 A | * | 3/1989 | Stolzman | B65D 15/08 220/618 |
| 4,915,254 A | * | 4/1990 | Zumsteg | B21D 51/383 220/265 |
| 4,951,833 A | * | 8/1990 | Carpenter, Jr. | B65D 3/30 220/634 |

(Continued)

FOREIGN PATENT DOCUMENTS

| | | |
|---|---|---|
| EP | 1800770 | 6/2007 |
| FR | 2639561 | 6/1990 |

(Continued)

*Primary Examiner* — Karren K Thomas
(74) *Attorney, Agent, or Firm* — BakerHostetler

(57) ABSTRACT

A tubular metal can body having one end for attachment of a removable overcap, the can body having an inwardly projecting flange (1) formed therein by folding the can wall (2) circumferentially, part-way along its length, the flange providing a convex upper surface (8) to which a peelable lid (12) can be sealed.

22 Claims, 5 Drawing Sheets

(56) References Cited

U.S. PATENT DOCUMENTS

| | | | | |
|---|---|---|---|---|
| 5,344,662 | A | 9/1994 | Payne et al. | |
| 5,688,544 | A | 11/1997 | Bolton et al. | |
| 5,725,120 | A * | 3/1998 | Ramsey et al. | 220/276 |
| 6,036,043 | A * | 3/2000 | Erfgen et al. | 220/270 |
| 7,156,252 | B2 * | 1/2007 | Morin | B65D 17/502 220/230 |
| 2011/0168713 | A1 * | 7/2011 | Oberholzer et al. | 220/359.2 |
| 2011/0272417 | A1 | 11/2011 | Holstine et al. | |

FOREIGN PATENT DOCUMENTS

| | | | |
|---|---|---|---|
| FR | 2639561 | A1 | 6/1990 |
| WO | WO 01/10731 | | 2/2001 |
| WO | WO 2009/148988 | A2 | 12/2009 |
| WO | WO 2013/010875 | A1 | 1/2013 |

* cited by examiner

METAL CANS WITH PEELABLE LIDS

CROSS-REFERENCE TO RELATED APPLICATIONS

This application is the National Stage of International Application No. PCT/EP2012/063585 filed Jul. 11, 2012, which claims the benefit of EP application number 11174917.2, filed July, 2011, the disclosures of which are incorporated herein by reference in their entirety.

TECHNICAL FIELD

The present invention relates to metal cans with peelable lids and in particular to the provision of a metal can having a flange to provide a surface for sealing the can with the peelable lid.

BACKGROUND ART

FR 2639561 discloses a metal can and a method of manufacturing the same, the metal can comprising an internal annular flange to which a peelable lid can be heat-sealed in order to hermetically close the can.

In that application a peelable lid has a heat sealable layer which is used to hermetically seal the can. An alternative heat sealing could involve providing adhesive around the upper surface of the flange and/or around the under surface of the peelable lid, heating the flange and applying downward pressure.

For some markets, the type of metal can described in FR 2639561 may be perfectly adequate. However, for more specialised markets, for example the infant formula market (i.e. metal cans that are used to store baby milk powder), the safety of babies and young children can be at risk, and so the cans, including the seals, are required to have very high performances even in the most hostile of environments. Therefore these metal cans are required to undergo a series of stringent tests before they are deemed as safe to use in the marketplace. For example, it is desirable that a metal can that is to be used to store infant formula powder does not lose its hermetic seal with the peelable lid, even when stored at high ambient temperatures such as 45° C. for periods in excess of 3 months with a pressure difference from inside to outside of the can, for example of 700 mbar (70 kPa). Typically the external pressure is standard (ambient) air pressure and the internal pressure is negative, often referred to as a "vacuum".

Under such conditions, it has been found that metal cans made in accordance with those described in the prior art are prone to suffering from "creep" in the seal. Creep is the tendency for the peelable lid to slowly move from its position on the flange, due for example to pressure differences, particularly at high temperatures. This can reduce the effectiveness of the seal between the peelable lid and the flange, and in some cases may cause the seal to fail completely. Metal cans that suffer from creep in this way cannot be used in the infant formula market as the seal is not deemed to seal the product to a high enough standard.

SUMMARY OF INVENTION

It is an object of the present invention to overcome or at least mitigate the problems discussed above which result from creep in the seal between a metal can with a flange and a peelable lid.

According to a first embodiment of the present invention there is provided a tubular metal can body having one end for attachment of a removable overcap, the can body having an inwardly projecting flange formed therein by folding the can wall circumferentially, part-way along its length, the flange providing a convex upper surface to which a peelable lid can be sealed.

The tubular metal can body may comprise a metal cylinder formed with a side seam or weld. With this type of can body, there are two distinct ends required to form the finished can, which is therefore what is known in the trade as a "three piece can".

Alternatively, the tubular metal can body may have been formed by punching a cup from a metal sheet and then drawing the cup into a taller can body with thinner side walls and integral base. When the open end of this type of can body is closed with a lid, the resultant can is known as a "two-piece can".

Embodiments of the present invention provide an improved metal can that is capable of providing a superior hermetic seal.

The convex upper surface may be domed.

The flange may extend radially into the can by between 1 mm and 10 mm for 100 mm diameter can bodies and may be scaled linearly according to diameter increase.

The height of the convex upper surface from its topmost point to its bottommost point may be up to half its radial extent. The shape of the lower surface is not critical.

The upper surface of the flange may be continuously convex across its radial extent.

According to a second embodiment of the present invention, there is provided a food storage container comprising a tubular metal can body as described in any of the preceding statements, and a peelable lid, the peelable lid being sealed to the convex upper surface of the flange, or a substantial part thereof.

The peelable lid may be sealed to the convex upper surface of the flange by a heat sealable material. Known peelable lidding material which could be used comprises a multi-layer membrane having typically a peelable polypropylene layer, a layer of aluminium, and an outer layer of print, lacquer, PET or other coating. Another laminated multi-layer structure may include a ceramic layer instead of the metal layer. There could also be an additional processable layer on the can body.

The food storage container may further comprise a non-removable can bottom attached to the lower end of the tubular metal can body.

The food storage container may further comprise an overcap such as a removable and replaceable overcap attached to the upper end of the tubular metal can body.

DESCRIPTION OF EMBODIMENTS

The subject being discussed herein is that of metal cans that are provided with peelable lids that hermetically seal the can, and which peelable lids can be peeled back and removed to open the can and provide access to the contents stored therein.

As discussed above, metal cans that are provided with flanges to seal with a peelable lid, are not currently able to be sealed to a high enough standard to pass the stringent tests that are required of metal cans used to contain certain high specification products, in particular infant formula powder.

Figure 1:
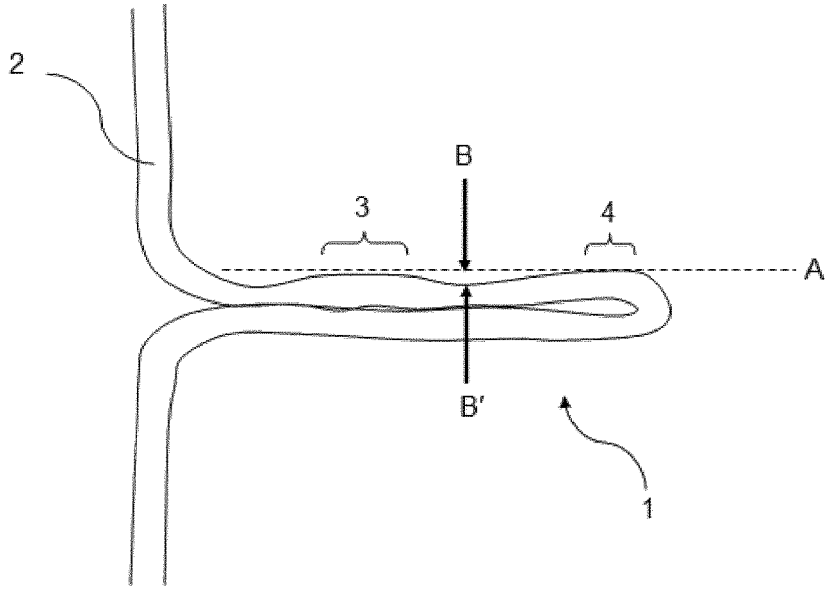
FIG. 1 shows a cross section through part of the side wall of a can with a flange as currently known in the prior art.

FIG. 1 shows a cross section through part of the side wall 2 of a metal can that has a flange 1 such as is known in the prior art. The upper surface of the flange does not provide a perfectly flat surface onto which a peelable lid can be sealed. Tests show that it is extremely difficult to obtain a completely flat upper surface on this type of flange. The horizontal dotted line A indicates that during the sealing process, when a peelable lid is positioned onto the upper surface of the flange from above, it would in fact only seal to the upper surface of the flange at the places marked 3 and 4. There is a sizable "trough" between arrows B and B' where air would be trapped between the two sealed portions at 3 and 4, which would prevent this area in between 3 and 4 from being properly sealed. As a consequence, there is a substantial reduction in the overall sealing area between the peelable lid and the flange, and this greatly weakens the seal in shear mode and increases the possibility of the seal suffering from creep.

A metal can will now be described, with reference to the figures, that comprises a flange which enables the formation of a continuous seal on substantially the entire radial extent of the flange in order to achieve a more robust seal. This is facilitated by providing the can with a flange that has a convex upper surface. Preferably the convex upper surface is domed, i.e. it has a central region of the radial extent of the upper surface higher than the radially inner and outer regions of the surface. The part of the upper surface to which the peelable lid adheres is continuously convex such that no "pockets" of trapped air are formed by troughs in the upper surface of the flange, which can reduce the overall sealing area and weaken the seal.

Figure 2:
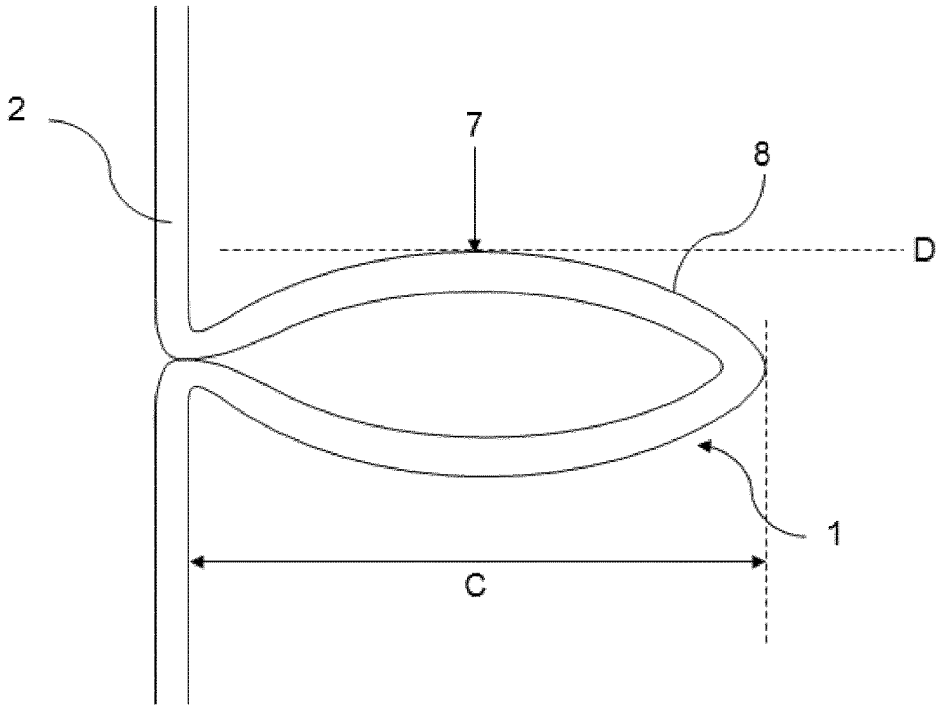
FIG. 2 shows a cross section through part of the side wall of a can with an improved flange according to an embodiment of the invention.

FIG. 2 shows a cross section through a side wall 2 of a metal can according to an embodiment of the invention. The flange 1 extends radially inward towards the centre of the metal can and has a domed shape, which gives rise to the convex upper surface 8. The horizontal dotted line D indicates that during the sealing process, when a peelable lid is positioned onto the upper surface of the flange from above, there is only one initial point of contact between the cover and the upper surface of the flange at point 7. As there are no second points of contact (such as those found in FIG. 1), no troughs will be formed that will trap air and weaken the seal.

The flange extends around the entire internal circumference of the metal can and so a peelable lid forms a substantially circular hermetic seal with the flange. The radial extent of the flange, as indicated by the distance C, can vary according to the requirements of the can. Typically this extent will be between 1 mm to 10 mm for can bodies with diameters of about 100 mm. Larger radial extents may be required for cans with larger diameters, and this may be achieved by scaling the radial extent of the flange linearly according to the can body diameter increase. A larger extent C will also provide a stronger seal with the peelable lid.

Figure 3:
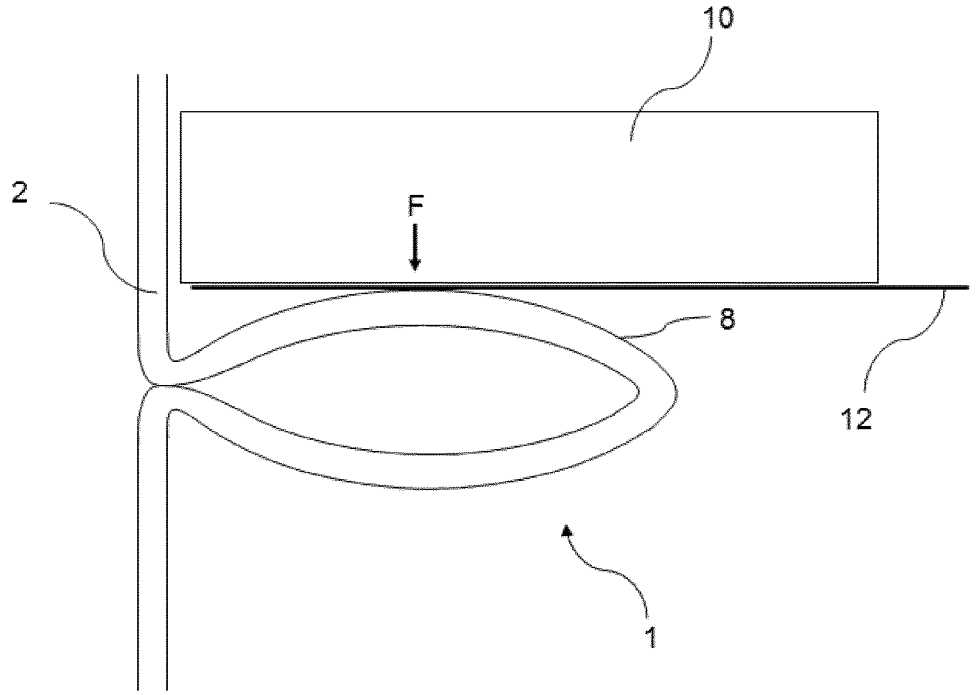
FIG. 3 shows the improved flange of FIG. 2 during a sealing operation.
Figure 4:
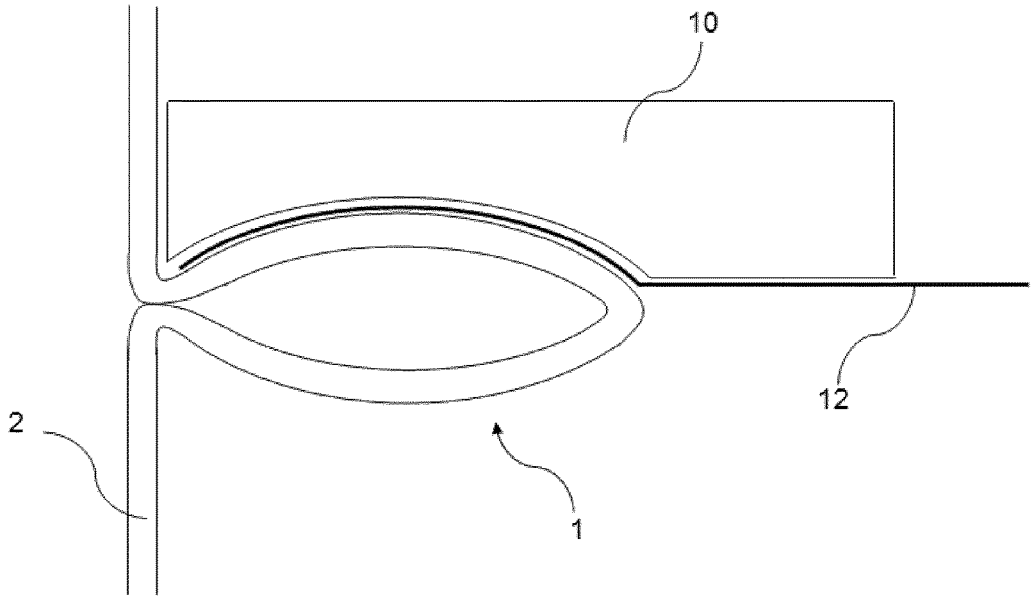
FIG. 4 shows the flange of FIG. 3 at a later stage in the sealing operation.

FIG. 3 shows the cross section of FIG. 2 during a heat sealing process in which the peelable lid is "punched" into place using a compliant punch 10. The compliant punch 10 has a deformable layer with a planar lower surface which can deform around the convex shape of the upper surface of the flange. Alternatively, the lower surface may be shaped to conform to the shape of the upper surface of the flange. During the heat sealing process, the punch 10 presses the peelable lid 12 down on the flange 1 as indicated by force F. The seal is started in the middle of the radial extent of the flange 1 at the topmost point of the convex upper surface. Then, as shown in FIG. 4, as the punch is pressed down onto the flange, the peak of the convex upper surface penetrates into the deformable layer on the punch 10. The deformable layer wraps around the curve of the convex upper surface, pressing and sealing the peelable lid 12 across the convex upper surface of the flange 1. The seal is made using a heat-sealable material, for example a thermoplastic material, placed between the peelable lid and the convex upper surface of the flange.

Alternatively, instead of having a compliant punch such as that described above, a full metal punch could be used to seal the can. A full metal punch does not have a deformable layer, and so would require the shape of the lower surface of the metal punch to perfectly complement the convex shape of the upper surface of the flange. This may be preferable in order to extend the life of the tool, as there is less wear of the materials over time, however it is extremely difficult to consistently achieve a perfectly complementary shape every time. Therefore, overall, the use of a compliant punch is preferred, as a compliant punch will adapt to slight changes in the range of cans and seal shapes created during a normal can manufacturing process.

Typically, the height of the convex upper surface 8 from its topmost point to its bottommost point is up to half its radial extent. Greater convex heights are likely to be required for flanges with larger radial extents.

Figure 5:
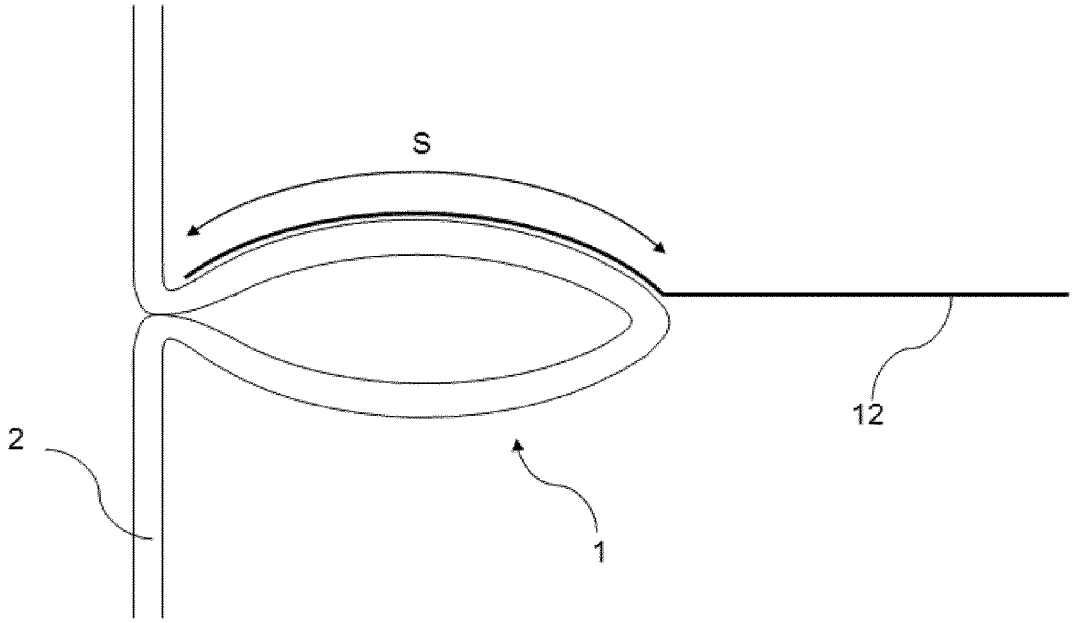
FIG. 5 shows the flange of FIGS. 3 and 4 with a peelable lid sealed to the flange.

FIG. 5 shows a cross section of the wall of the metal can after the peelable lid 12 has been heat-sealed to the convex upper surface of the flange. The arrow S shows the uninterrupted width of the seal that is formed over substantially the whole radial extent of the flange, which is achieved due to the convex shape of the upper surface that does not allow for any trapped air troughs to be formed.

Figure 6:
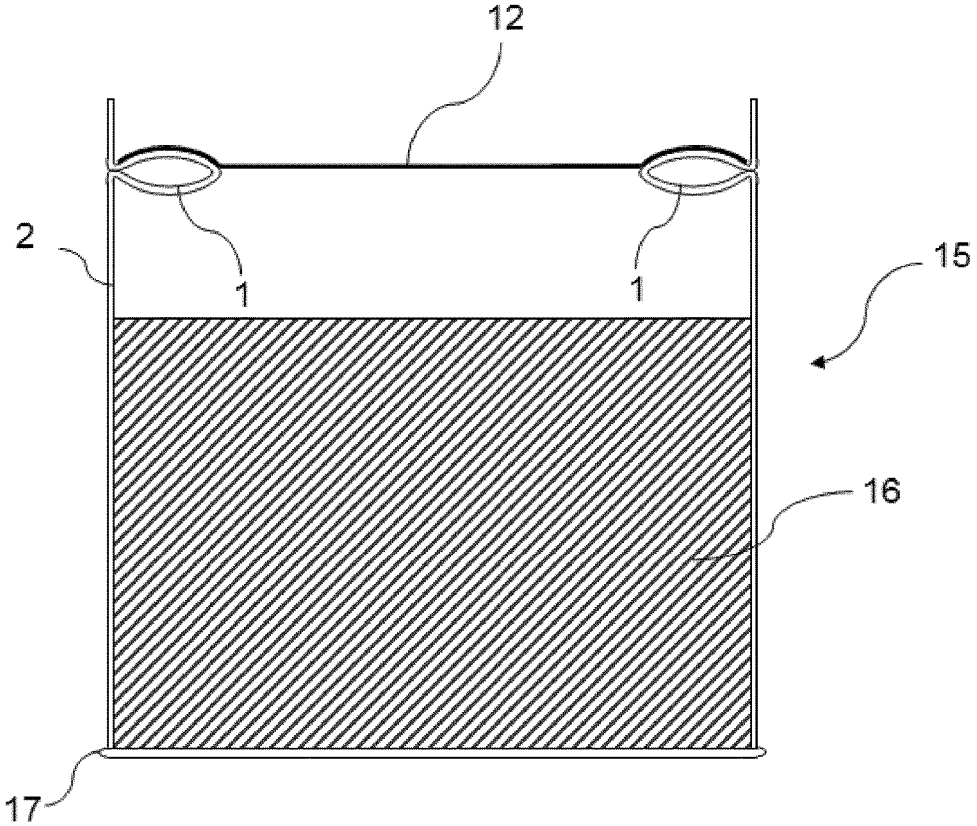
FIG. 6 shows a cross-sectional view of a metal can body with a flange and a peelable lid sealed to the flange.

FIG. 6 shows a cross section through a metal can 15 storing a powder 16. The metal can has a domed flange 1 formed in the can wall 2. The flange 1 provides a convex upper surface to which a peelable lid 12 has been heat sealed. The peelable lid 12 can comprise a tab, or similar, such that the consumer can more easily remove the peelable lid by peeling it off the flange. The can is provided with a non-removable base, or "can bottom", 17 which seals the opening at the bottom end of the can. Although not shown in FIG. 6, the can may further be provided with a removable plastic overcap that is placed over the opening at the top end of the can. This plastic overcap enables the can to be reclosed once the seal has been broken and the peelable lid removed.

The flange 1 is shown in FIG. 6 as being near the open end of the metal can, however the flange may be formed lower down the can wall, thus enabling the seal to separate two distinct portions of the can. For example, the lower portion that is hermetically sealed by the peelable lid may contain infant formula power, and the upper portion provides a separate area where, for example, a scoop or spoon can be stored. A further flange may be provided towards the top of the can to seal the section of the can containing the scoop to ensure that it is kept in a sterile environment prior to a consumer opening and using it.

It is also possible to form flanges at both open ends of a tubular can body (which has a welded side seam) and to close both ends with respective peelable lids.

During the manufacturing process for cans such as those described herein, a can supplier may typically manufacture tubular metal cans with the flange with the convex upper surface and will heat-seal the peelable lid to it. The cans, with open bottom ends, will then be sent to the supplier's customers. Can bottoms and plastic overcaps are generally supplied separately. The supplier's customer can then fill the can with their product from the opening in the bottom of the can before sealing the can by securing the non-removable can bottom in place. The plastic overcap can then be placed on the top end of the can. If required, a spoon or scoop can be placed in the can on top of the peelable lid, prior to the plastic overcap being put in place.

Figure 7:
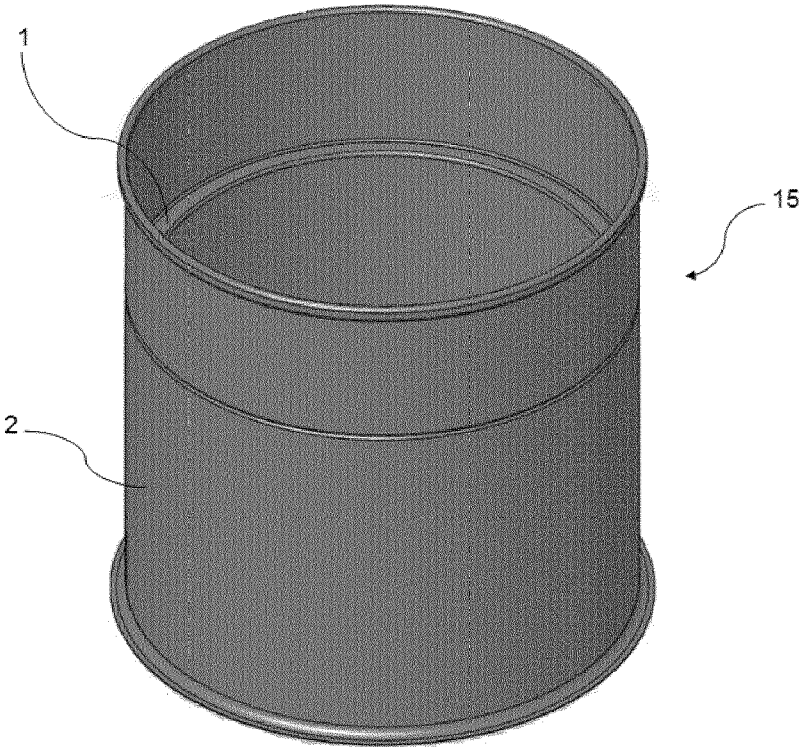
FIG. 7 shows a perspective view of a metal can body according to an embodiment of the invention.
Figure 8:
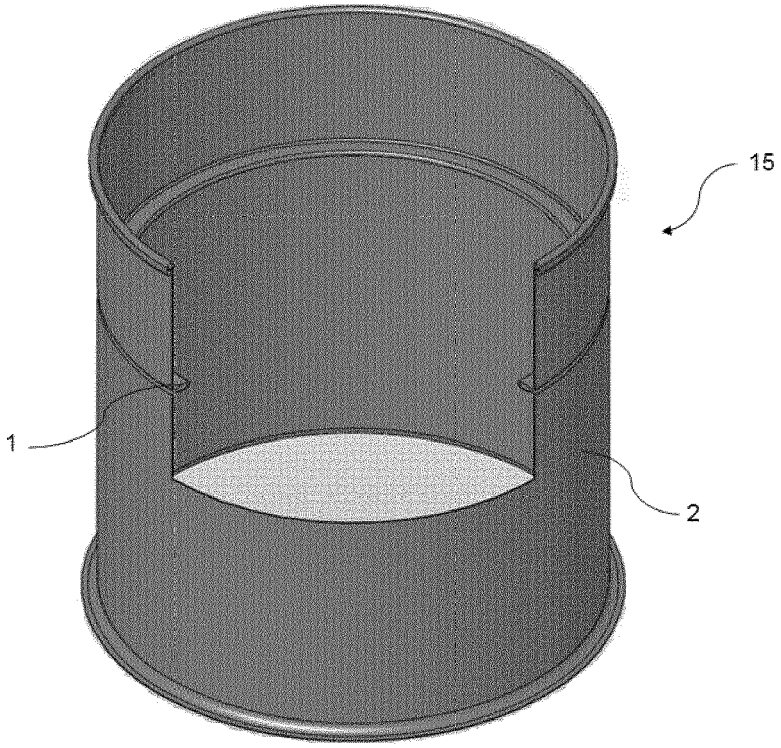
FIG. 8 shows the metal can body of FIG. 7 with part of the can wall removed in order to show the flange cross-section.

FIG. 7 shows a metal can 15 in perspective from above. This view shows that the flange 1 is formed in the can wall 2 part-way down its length, and that the flange extends around the entire inner circumference of the metal can 15. FIG. 8 shows the metal can 15 of FIG. 7, with part of the can wall 2 removed in order that the domed shape of the flange 1, which gives rise to the convex upper surface, can be seen.

Figure 9:
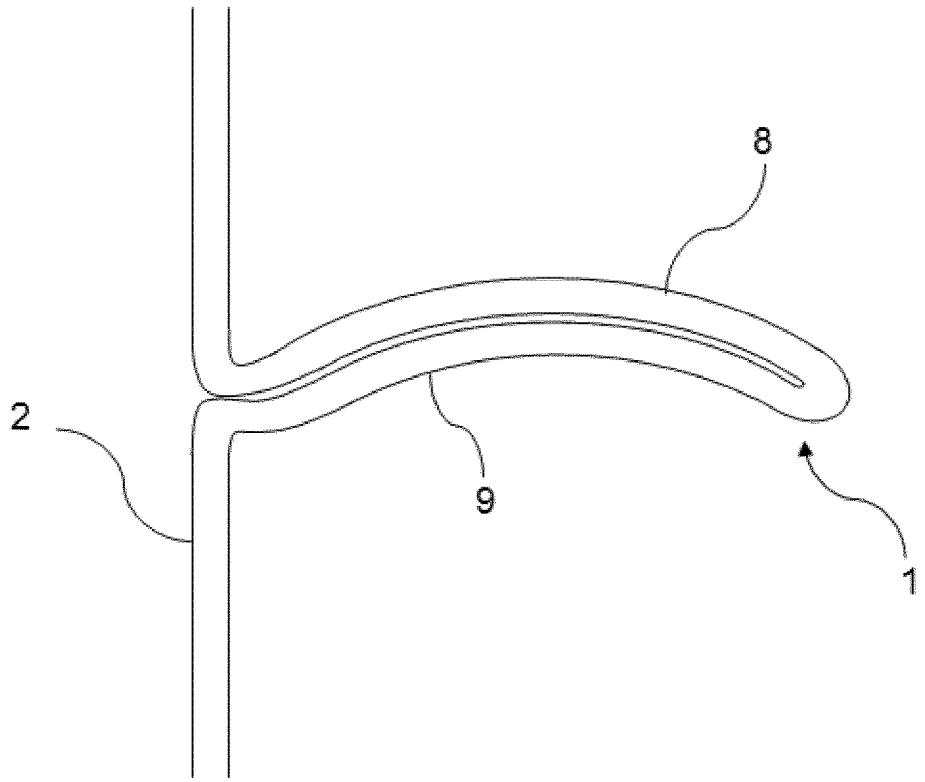
FIG. 9 shows a cross section through part of the side wall of a can with a flange according to an alternative embodiment of the invention.

It will be appreciated by the person of skill in the art that various modifications may be made to the above described embodiments without departing from the scope of the present invention. For example, the shape of the flange may not be entirely domed. For instance, the shape of the lower surface of the flange which is not critical, as it is not used for sealing to the peelable lid, may be substantially flat, or, as shown in FIG. 9, the lower surface of the flange 9 may have an upwardly convex shape that complements the convex shape of the upper surface 8.

A further modification may be that the peelable lid is plastic. Alternatively, the lid may be a multi-layer structure which includes a ceramic layer such as silica or alumina instead of metal.

The invention claimed is:

1. A tubular metal can body comprising a seamless can wall that defines a can wall length, the seamless can wall including a circumferential fold part-way along the can wall length that forms an inwardly projecting flange, the fold defining a radial distance with a peak at a midpoint of the radial distance of the fold, the can body configured such that a peelable lid can be directly adhered to substantially an entire length of an upper portion of the fold, such that a portion of the peelable lid that is adhered to substantially the entire length of the upper portion of the fold has a radial distance and a peak at a midpoint of the radial distance of the portion of the peelable lid, wherein the upper portion of the fold is continuously convex across its radial extent, and wherein a maximum height of the upper portion of the fold from the peak to its bottommost point is up to half of a radial extent defined by the convex upper surface.

2. A tubular metal can body as claimed in claim 1, wherein the upper portion of the fold is domed.

3. A tubular metal can body as claimed in claim 1, wherein the radial distance of the fold is between 1 mm and 10 mm.

4. A tubular metal can body as claimed in claim 1, wherein the can wall includes an upper circumferential wall portion connected to the upper portion of the fold by a first bend, the can wall further including a lower circumferential wall portion connected to a bottom portion of the fold by a second bend, the first bend being disposed above the second bend.

5. A tubular metal can body as claimed in claim 1, wherein the upper portion of the fold is symmetrical about a line that extends through the upwardly extending peak and parallel to the seamless can wall.

6. A food storage container comprising:

a tubular metal can body comprising a seamless can wall that defines a can wall length, the seamless can wall including a circumferential fold part-way along the can wall length that forms an inwardly projecting flange, the fold defining a radial distance with a peak at a midpoint of the radial distance of the fold, wherein the upper surface of the flange is continuously convex across its radial extent; and a peelable lid, the peelable lid being directly adhered to substantially an entire length of an upper portion of the fold, such that a portion of the peelable lid that is adhered to substantially the entire length of the upper portion of the fold has a radial distance and a peak at a midpoint of the radial distance of the portion of the peelable lid, wherein a maximum height of the upper portion of the fold from the peak to its bottommost point is up to half of a radial extent defined by the convex upper surface.

7. A food storage container as claimed in claim 6, wherein the peelable lid is sealed to the upper portion of the fold by a heat-sealable material.

8. A food storage container as claimed in claim 6, wherein the peelable lid is a multi-layer structure which includes a metal layer.

9. A food storage container as claimed in claim 6, wherein the food storage container further comprises a non-removable can bottom attached to a lower end of the tubular metal can body.

10. A food storage container as claimed in claim 6, wherein the food storage container further comprises a removable overcap attached to an upper end of the tubular metal can body.

11. A food storage container as claimed in claim 6, wherein the can wall includes an upper circumferential wall portion connected to upper portion of the fold by a first bend, the can wall further including a lower circumferential wall portion connected to a bottom portion of the fold by a second bend, the first bend being disposed above the second bend.

12. A tubular metal can body as claimed in claim 6, wherein the upper portion of the fold is symmetrical about a line that extends through the upwardly extending peak and parallel to the seamless can wall.

13. A food storage container consisting essentially of:

a tubular metal can body comprising a seamless can wall that defines a can wall length, the seamless can wall including a circumferential fold part-way along the can wall length that forms an inwardly projecting flange, the flange having a convex upper surface that defines an upwardly extending peak, the peak defining an uppermost point of the convex upper surface, wherein the upper surface of the flange is continuously convex across its radial extent, and wherein a maximum height of the upper portion of the fold from the peak to its bottommost point is up to half of a radial extent defined by the convex upper surface; and a peelable lid, the peelable lid being directly adhered to the upper-most point of the convex upper surface of the flange.

14. A food storage container as claimed in claim 13, wherein the convex upper surface is domed.

15. A food storage container as claimed in claim 13, wherein the flange extends radially into the can by between 1 mm and 10 mm.

16. A food storage container as claimed in claim 13, wherein the peelable lid is sealed to the convex upper surface of the flange by a heat-sealable material.

17. A food storage container as claimed in claim 13, wherein the peelable lid is a multi-layer structure which includes a metal layer.

18. A food storage container as claimed in claim 13, wherein the food storage container further comprises a non-removable can bottom attached to a lower end of the tubular metal can body.

19. A food storage container as claimed in claim 13, wherein the food storage container further comprises a removable overcap attached to an upper end of the tubular metal can body.

20. A food storage container as claimed in claim 13, wherein the peak is disposed at an approximate midpoint of the length of the inwardly projecting flange.

21. A food storage container as claimed in claim 13, wherein the can wall includes an upper circumferential wall portion connected to the upper portion of the fold by a first bend, the can wall further including a lower circumferential wall portion connected to a bottom portion of the fold by a second bend, the first bend being disposed above the second bend.

22. A tubular metal can body as claimed in claim 13, wherein the upper portion of the fold is symmetrical about a line that extends through the upwardly extending peak and parallel to the seamless can wall.

* * * * *